US009694584B2

(12) United States Patent
Masaoka et al.

(10) Patent No.: US 9,694,584 B2
(45) Date of Patent: Jul. 4, 2017

(54) LIQUID EJECTOR AND LIQUID EJECTING DETECTOR

(71) Applicants: Shingo Masaoka, Kanagawa (JP); Shotaro Takeuchi, Kanagawa (JP); Masahiko Hisada, Kanagawa (JP); Kenta Takahashi, Kanagawa (JP)

(72) Inventors: Shingo Masaoka, Kanagawa (JP); Shotaro Takeuchi, Kanagawa (JP); Masahiko Hisada, Kanagawa (JP); Kenta Takahashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/217,088

(22) Filed: Jul. 22, 2016

(65) Prior Publication Data

US 2016/0325550 A1 Nov. 10, 2016

Related U.S. Application Data

(63) Continuation of application No. PCT/JP2015/054226, filed on Feb. 17, 2015.

(30) Foreign Application Priority Data

Feb. 24, 2014 (JP) ..... 2014-033299

(51) Int. Cl.
*B41J 2/165* (2006.01)

(52) U.S. Cl.
CPC ..... *B41J 2/16538* (2013.01); *B41J 2/16541* (2013.01); *B41J 2/16579* (2013.01)

(58) Field of Classification Search
CPC B41J 2/16538; B41J 2/16541; B41J 2/16579; B41J 2/04558; B41J 2/0456;
(Continued)

(56) References Cited

U.S. PATENT DOCUMENTS 5,905,513 A 5/1999 Brandon et al.
8,919,921 B2 12/2014 Takeuchi
(Continued)

FOREIGN PATENT DOCUMENTS

JP H09-131885 5/1997
JP 2002-079680 3/2002
(Continued)

OTHER PUBLICATIONS

Takeuchi Shotaro, MachineTranslationofJP 2014097642 A, 2012.*
(Continued)

*Primary Examiner* — Geoffrey Mruk
*Assistant Examiner* — Scott A Richmond
(74) *Attorney, Agent, or Firm* — Cooper & Dunham LLP

(57) ABSTRACT

A liquid ejector includes a head having a plurality of nozzles arranged along a first direction of a nozzle surface of the head to eject a droplet from the nozzles, and an ejection detector to detect whether or not a droplet is ejected from the plurality of nozzles of the head by detecting an electrical change generated when the droplet lands onto the ejection detector. The ejection detector includes a droplet landing surface arranged opposed to the nozzle surface, a wiper to wipe the droplet off the droplet landing surface along the first direction, and a cleaner having a contact surface to remove the droplet adhered to the wiper after the wiper wipes the droplet landing surface. The contact surface has a curvature such that side ends of the wiper contacts with the contact surface at first, and then a center part of the wiper contacts the contact surface.

8 Claims, 17 Drawing Sheets

(58) Field of Classification Search
CPC ..... B41J 2/04561; B41J 2/0451; B41J 2/165; B41J 2002/16529
See application file for complete search history.

(56) References Cited

U.S. PATENT DOCUMENTS

| | | | | |
|---|---|---|---|---|
| 8,967,759 | B2 | 3/2015 | Masaoka et al. | |
| 9,028,039 | B2 | 5/2015 | Masaoka et al. | |
| 2013/0083123 | A1* | 4/2013 | Tanabe | B41J 2/165 347/33 |
| 2014/0210908 | A1* | 7/2014 | Ogata | B41J 2/16541 347/33 |

FOREIGN PATENT DOCUMENTS

| | | | |
|---|---|---|---|
| JP | 2004-306475 | | 11/2004 |
| JP | 2008-114507 | | 5/2008 |
| JP | 2009-279765 | | 12/2009 |
| JP | 2010-046962 | | 3/2010 |
| JP | 4735120 | | 7/2011 |
| JP | 2014097642 | A * | 5/2014 |
| JP | 2015-074106 | | 4/2015 |

OTHER PUBLICATIONS

International Search Report Issued on Apr. 21, 2015 in PCT/JP2015/054226 filed on Feb. 17, 2015 (with English Translation).

* cited by examiner

LIQUID EJECTOR AND LIQUID EJECTING DETECTOR

CROSS-REFERENCE TO RELATED APPLICATIONS

The present application is a continuation application of International Application No. PCT/JP2015/054226, filed Feb. 17, 2015, which claims priority to Japanese Patent Application No. 2014-033299, filed Feb. 24, 2014. The contents of these applications are incorporated herein by reference in their entirety.

BACKGROUND OF THE INVENTION

1. Field of the Invention

The embodiments of the present disclosure relate to liquid ejectors and liquid ejecting detectors.

2. Description of the Related Art

An inkjet recording apparatus, for example, which ejects ink droplets from a recording head to form an image, is known as a liquid ejector for a printer, a facsimile machine, a copier, a plotter, a multifunction peripheral, etc.

Such an inkjet recording apparatus may be provided with a liquid ejecting detector which detects a condition of ejection of ink droplets from the recording head. In a case that a nozzle performing abnormal ejection of an ink droplet is detected by the liquid ejecting detector, a maintenance-and-recovery operation for the recording head, such as cleaning of a nozzle surface is, performed.

A liquid ejecting detector known in the art, for example, causes a recording head to eject a droplet toward an electrode plate, and then detects an electronic change that occurs when the droplet lands onto the electrode plate, thereby detecting whether or not a droplet is ejected (for example, see Japanese Patent No. 4735120).

Furthermore, a liquid ejecting detector is known in the art that cleans an electrode plate as described above with a wiper member that wipes the electrode plate while moving in the same direction as the moving direction of a carriage (for example, see Japanese Unexamined Patent Application Publication No. 2004-306475).

When a wiper member performs wiping, waste liquid is attached to the wiper member, which may cause a decrease in wiping quality over time. Therefore, a cleaner may be applied in order to scrape off the waste liquid adhered to the wiper member.

Here, for example, waste liquid adhered to the wiping surface of the wiper may be scraped off with a scraper (a cleaner) having a straight ridge line, by making the flat surface of the wiper make contact with the scraper. In this case, the waste liquid runs off to the side ends in the direction perpendicular to the wiping direction of the wiper. As a result, waste liquid tend to accumulate on the scraper on both sides of the area which makes contact with the wiper.

In a case that waste liquid is accumulated on the cleaner in such a way, the accumulated waste liquid may interfere with the recording head or may become attached to the wiper, which may cause a decrease of wiping quality.

An object of an embodiment of the present invention is to reduce accumulation of waste liquid on the cleaner and to prevent a decrease of wiping quality of the wiper member.

SUMMARY OF THE INVENTION

One aspect of the present invention provides a liquid ejector including a head having a plurality of nozzles arranged along a first direction of a nozzle surface of the head to eject a droplet from the nozzles, and an ejection detector to detect whether or not a droplet is ejected from the plurality of nozzles of the head by detecting an electrical change generated when the droplet lands onto the ejection detector. The ejection detector includes a droplet landing surface arranged opposed to the nozzle surface, on which the droplet ejected from the plurality of nozzles of the head lands, a wiper to wipe the droplet off the droplet landing surface along the first direction, and a cleaner having a contact surface to remove the droplet adhered to the wiper by relatively moving the wiper and the contact surface in the first direction while the wiper deforms elastically by contact and pressed against the contact surface of the cleaner after the wiper wipes the droplet landing surface. The contact surface has a curvature such that side ends of the wiper, arranged in a second direction perpendicular to the first direction, contacts with the contact surface at first, and then a center part of the wiper contacts the contact surface.

Furthermore, another aspect of the present invention provides a liquid ejecting detector to detect whether or not a droplet is ejected from a head having a plurality of nozzles including a droplet landing surface on which the droplet lands, a wiper to wipe the droplet off the droplet landing surface, and a cleaner having a contact surface to remove the droplet adhered to the wiper, the wiper deformed elastically when being contact and pressed against the contact surface of the cleaner after the wiper wipes the droplet landing surface. The contact surface has a curvature such that side ends of the wiper, arranged in a second direction perpendicular to the first direction, contacts with the contact surface at first, and then a center part of the wiper contacts the contact surface.

The following description, referring to the attached drawings, helps to provide a clearer understanding regarding the other objects, characteristics, and advantages of the present invention.

According to an embodiment of the present invention, a decrease in wiping quality of the wiper member is prevented and adequate wiping quality is sustained for a long period of time.

DESCRIPTION OF THE EMBODIMENTS

Figure 1:
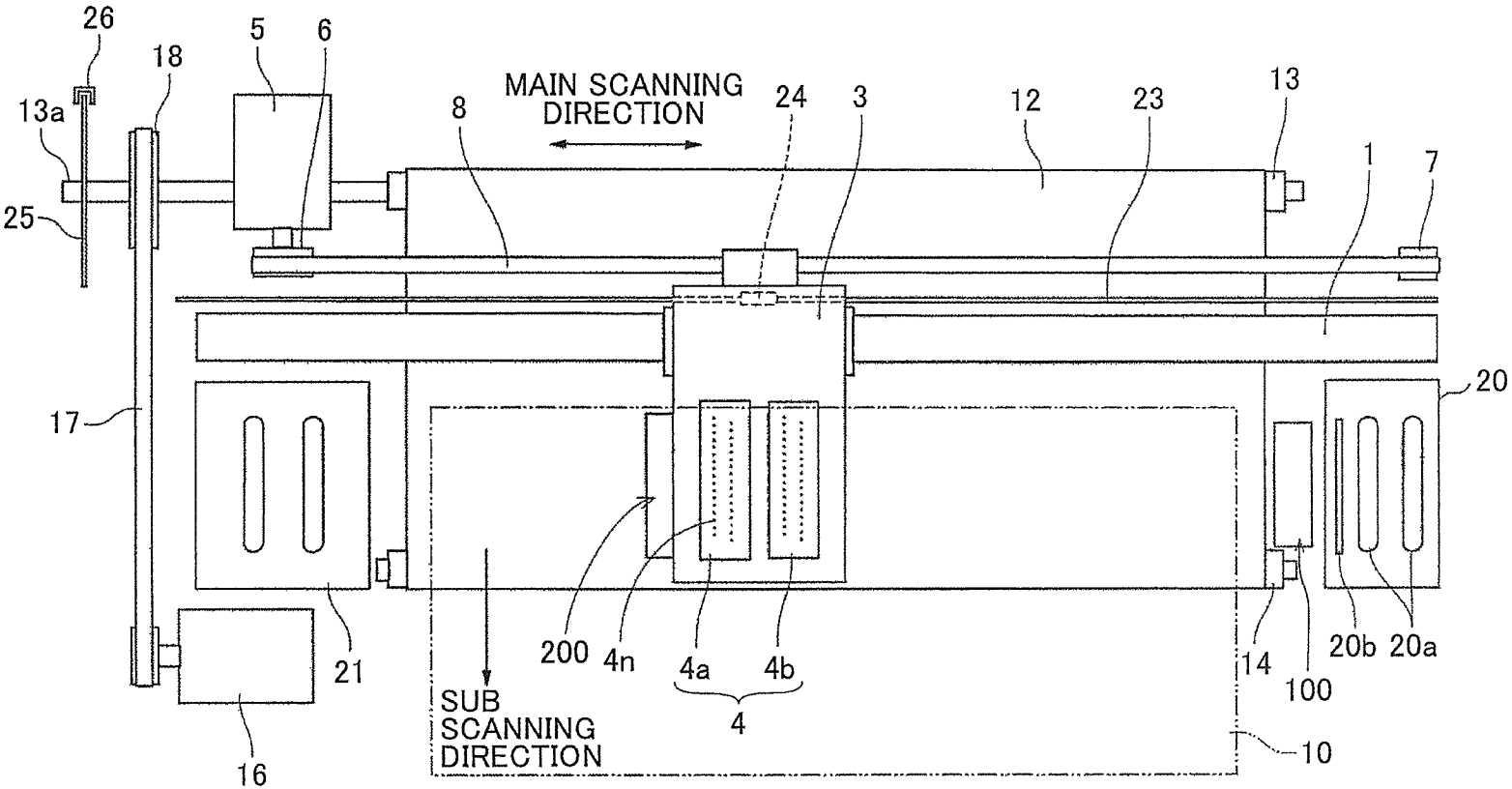
FIG. 1 is a plan view of a mechanical section of a liquid ejector according to a first embodiment of the present invention.

Embodiments of the present invention are described in the following, referring to the attached drawings. First, a liquid ejector to which the present invention is applicable is described, referring to FIG. 1. FIG. 1 is a plan view of the liquid ejector.

The liquid ejector illustrated in FIG. 1 is a serial type inkjet recording apparatus. In the liquid ejector, a main guide 1 and a sub guide (not illustrated in the drawing) are placed, extending between the left and right side plates (not illustrated in the drawing). A carriage 3 is supported by the main guide 1 and the sub guide so as to be movable. The carriage 3 is connected to a timing belt 8 which extends around a driving pulley 6, driven by a main scanning motor 5, and a driven pulley 7. The main scanning motor 5 drives the driving pulley 6 to cause the timing belt 8 to circulate. In this way, the carriage 3 moves back and forth in the main scanning direction (the moving direction of the carriage).

The carriage 3 is provided with a recording head 4 that includes a recording head member 4*a* and a recording head member 4*b*, which serve as liquid ejection heads. The recording head 4 ejects ink droplets of colors, such as yellow (Y), cyan (C), magenta (M), and black (K). Furthermore, each of the recording head member 4*a* and the recording head member 4*b* has multiple nozzle rows arranged along the main scanning direction. Each of the nozzle rows has multiple nozzles 4*n* aligning along the sub scanning direction perpendicular to the main scanning direction. The nozzles 4*n* are installed in a way that a droplet ejecting direction is downward.

Figure 2:
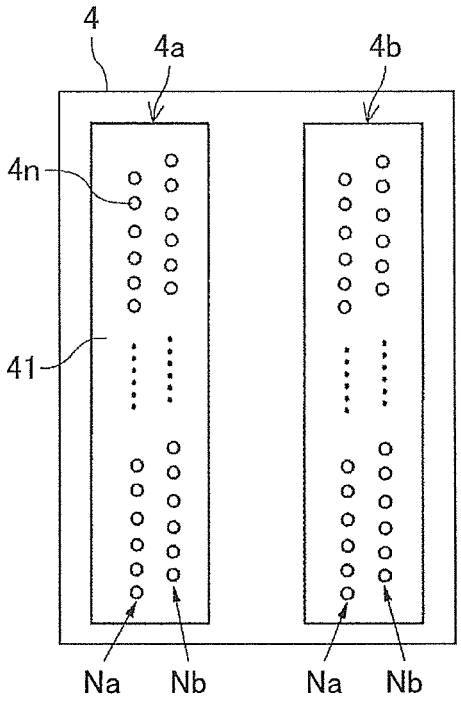
FIG. 2 is a drawing for an explanation of a recording head of the liquid ejector.

Specifically, as illustrated in FIG. 2, each of the recording head member 4*a* and the recording head member 4*b* of the recording head 4 has two nozzle rows, a nozzle row Na and a nozzle row Nb, which consist of aligned multiple nozzles 4*n*. The nozzles 4*n* in the nozzle row Na of the recording head member 4*a* eject black (K) droplets and the nozzles 4*n* in the nozzle row Nb eject cyan (C) droplets. The nozzle row Na of the recording head member 4*b* ejects magenta (M) droplets and the nozzle row Nb ejects yellow (Y) droplets.

An actuator of the liquid ejection heads constituting the recording head 4 may be, for example, a piezoelectric actuator using a piezoelectric element or a thermal actuator using phase change generated in film boiling of liquid caused by an electro-thermal conversion element such as a heat-generating resistor.

The liquid ejector is provided with a conveyance belt 12 which catches a sheet 10 using electrostatic attraction and conveys the sheet 10 while the sheet 10 is facing the recording head 4. The conveyance belt 12 is an endless belt which extends around a conveyance roller 13 and a tension roller 14.

A sub scanning motor 16 rotates the conveyance roller 13 through the intermediaries of a timing belt 17 and a timing pulley 18 so that the conveyance belt 12 circulates in the sub scanning direction. While circulating, the conveyance belt 12 is charged electrically by a charging roller (not illustrated in the drawing).

A maintenance-and-recovery assembly 20 is located beside the conveyance belt 12 at one end in the main scanning direction of the carriage 3 in order to perform maintenance and recovery of the recording head 4. A dummy ejection receiver 21 is located beside the conveyance belt 12 at the other end in the main scanning direction of the carriage 3 in order to receive an ink droplet ejected through a dummy ejection of the recording head 4.

The maintenance-and-recovery assembly 20, for example, includes a cap member 20*a* which caps a nozzle surface (a surface where nozzles are installed) of the recording head 4 and a wipe member 20*b* which wipes the nozzle surface. Moreover, the maintenance-and-recovery assembly 20 includes a dummy ejection receiver (not illustrated in the drawing) to receive ejection of droplets which do not contribute to forming an image.

A liquid ejecting detector 100 is located outside the recording region and between the conveyance belt 12 and the maintenance-and-recovery assembly 20, where the liquid ejecting detector 100 can face the recording head 4. The carriage 3 is provided with a cleaning unit 200 which cleans an electrode plate 101 described below attached to the liquid ejecting detector 100.

An encoder scale 23 on which a predetermined pattern is formed is placed along the main scanning direction of the carriage 3, extending between the side plates of the liquid ejector. The carriage 3 is provided with a main scanning encoder sensor 24 which consists of a transmission photosensor that reads the pattern of the encoder scale 23. The encoder scale 23 and the main scanning encoder sensor 24 form a linear encoder (a main scanning encoder) which detects the movement of the carriage 3.

A code wheel 25 is attached to a rotary shaft 13*a* of the conveyance roller 13. Beside the code wheel 25 is placed a sub scanning encoder sensor 26 which consists of a transmission photosensor. The sub scanning encoder sensor 26 reads the pattern formed on the code wheel 25. The code wheel 25 and the sub scanning encoder sensor 26 form a rotary encoder (a sub scanning encoder) which detects the moved amount and the moved position of the conveyance belt 12.

The sheet 10 is fed into the liquid ejector having a structure as described above, from a sheet feeding tray (not illustrated in the drawing) onto the electrically charged conveyance belt 12. The fed sheet 10 is caught by the conveyance belt 12 using electrostatic attraction. The sheet 10 is conveyed in the sub scanning direction though the circulation of the conveyance belt 12.

The recording head 4 is operated based on an image signal while the carriage 3 is moving in the main scanning direction so that the recording head 4 ejects ink droplets on the sheet 10 while the sheet 10 is pausing. This is how recording a line is performed. Then, after the sheet 10 is conveyed a predetermined distance, recording the next line is performed.

The liquid ejector finishes a recording operation in response to a recording completion signal or a signal that indicates that the rear end of the sheet 10 has reached the recording region, and then outputs the sheet 10 to a paper ejection tray (not illustrated in the drawing).

Figure 3:
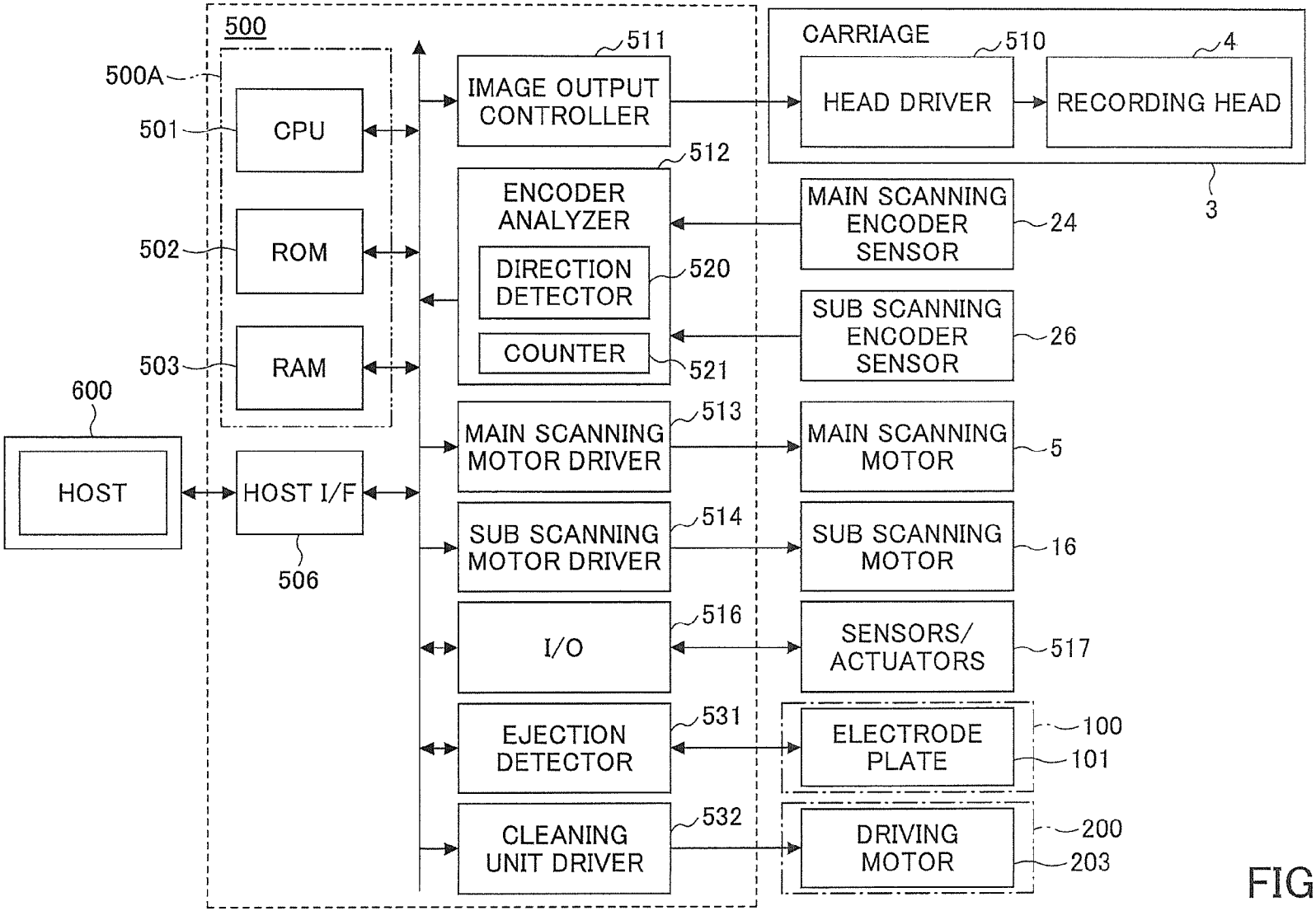
FIG. 3 is a block diagram of a control unit of the liquid ejector.

Next, an overview of a control unit of the above described liquid ejector is explained, referring to FIG. 3. FIG. 3 is a block diagram of the control unit.

A control unit 500 has a main control unit 500A. The main control unit 500A includes a central processing unit (CPU) 501, a read-only memory (ROM) 502, and a random access memory (RAM) 503. The CPU 501 centrally controls the liquid ejector. The ROM 502 stores programs executed by the CPU 501 and other fixed data. The RAM 503 temporarily stores image data, etc.

Furthermore, the control unit 500 includes a host interface (I/F) 506 which enables transmission of data between a host (an information processing apparatus) 600 such as a personal computer (PC), an image output controller 511 which controls the recording head 4, and an encoder analyzer 512 which analyzes detected signals provided from the main scanning encoder sensor 24 and the sub scanning encoder sensor 26.

Furthermore, the control unit 500 includes a main scanning motor driver 513 which drives the main scanning motor 5, a sub scanning motor driver 514 which drives the sub scanning motor 16, and an input-output (I/O) 516 which enables transmission of data and signals between various types of sensors/actuators 517.

Furthermore, the control unit 500 includes an ejection detector 531 which interprets (or detects) an electronic change that occurs when a droplet lands onto the electrode plate 101 attached to the liquid ejecting detector 100 to determine whether or not a droplet is ejected. Furthermore, the control unit 500 includes a cleaning unit driver 532 which drives a driving motor 203 of the cleaning unit 200 that wipes the electrode plate 101 attached to the liquid ejecting detector 100.

The image output controller 511 includes a data generator which generates image data, a driving waveform generator which generates driving waveforms to control the recording head 4, and a data transmitter which transmits image data and head controlling signals for selecting desired driving signals from the driving waveforms. The image output controller 511 transmits driving waveforms, head controlling signals, and image data to a head driver 510 which is a head driving circuit to drive the recording head 4 mounted on the carriage 3, so that the nozzles of the recording head 4 eject droplets according to the image data.

The encoder analyzer 512 has a direction detector 520 which detects moving directions based on detected signals and a counter 521 which detects moving amounts.

The control unit 500 controls the main scanning motor 5 using the main scanning motor driver 513 based on an analysis outcome provided from the encoder analyzer 512, thereby controlling the movement of the carriage 3. Furthermore, the control unit 500 controls the sub scanning motor 16 using the sub scanning motor driver 514, thereby controlling conveyance of the sheet 10.

The main control unit 500A of the control unit 500 moves the recording head 4 when a detection of droplet ejection is performed. The main control unit 500A causes the recording head 4 to eject droplets from predetermined nozzles in order to detect a condition of droplet ejection based on the detected signals provided from the ejection detector 531.

Figure 4:
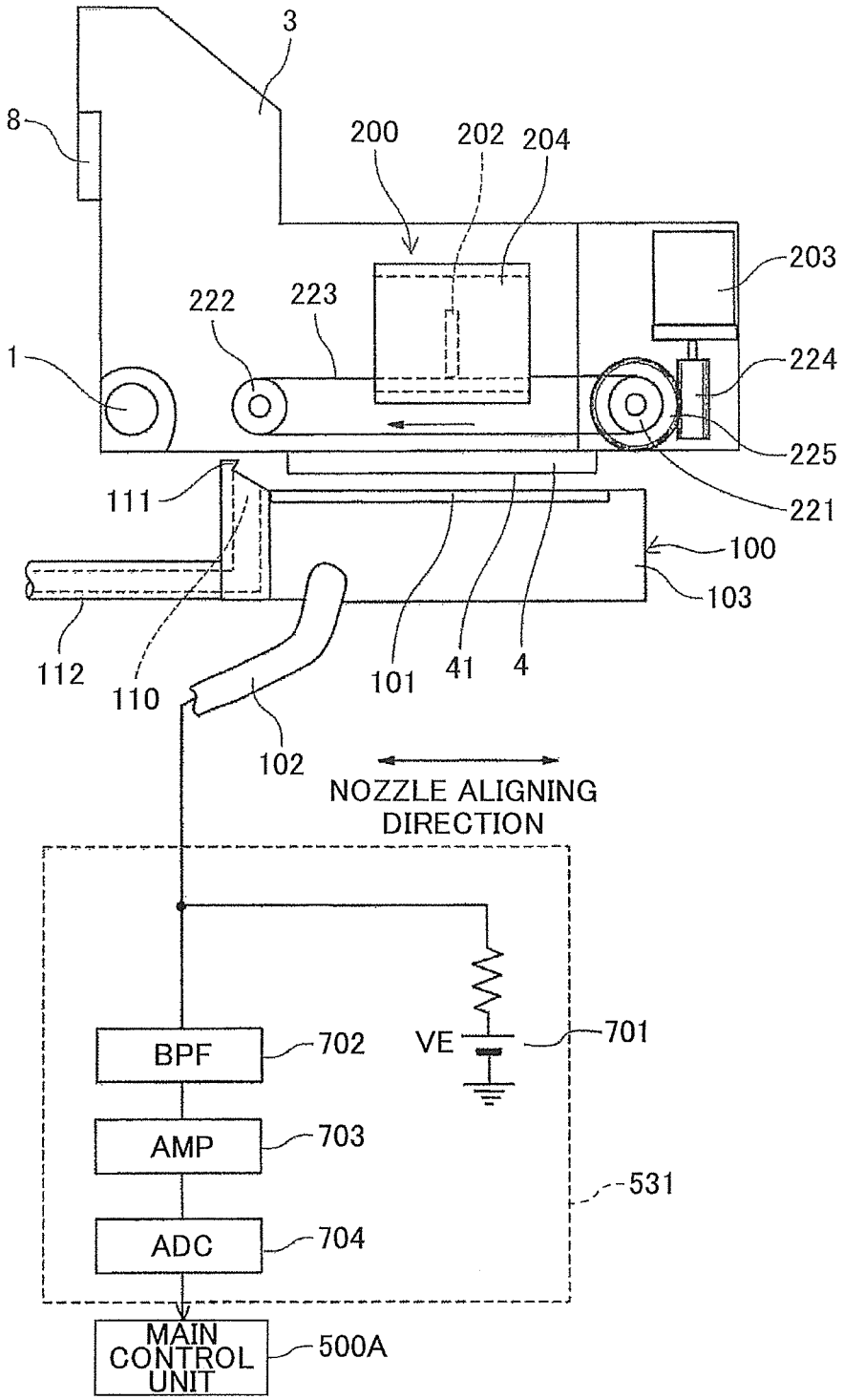
FIG. 4 is a side view of a liquid ejecting detector and a carriage.
Figure 5A:
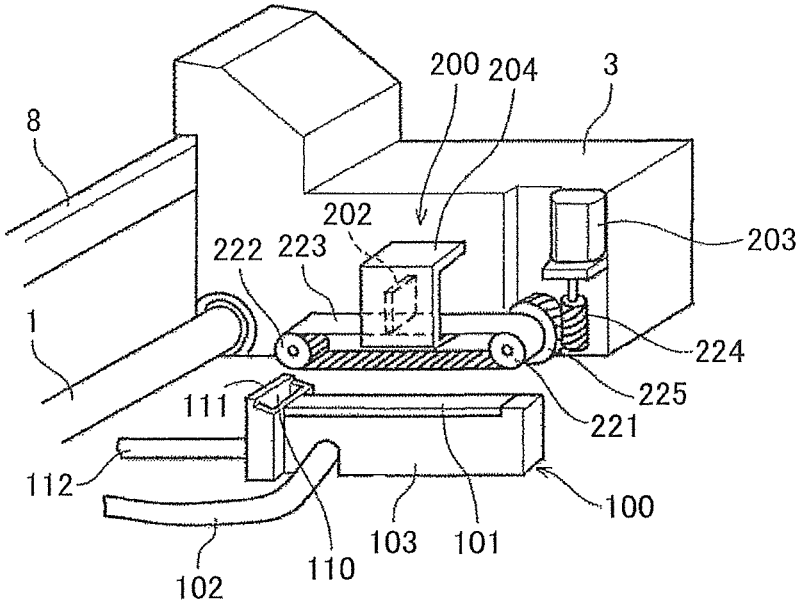
FIG. 5A is a perspective view of the liquid ejecting detector and the carriage.
Figure 5B:
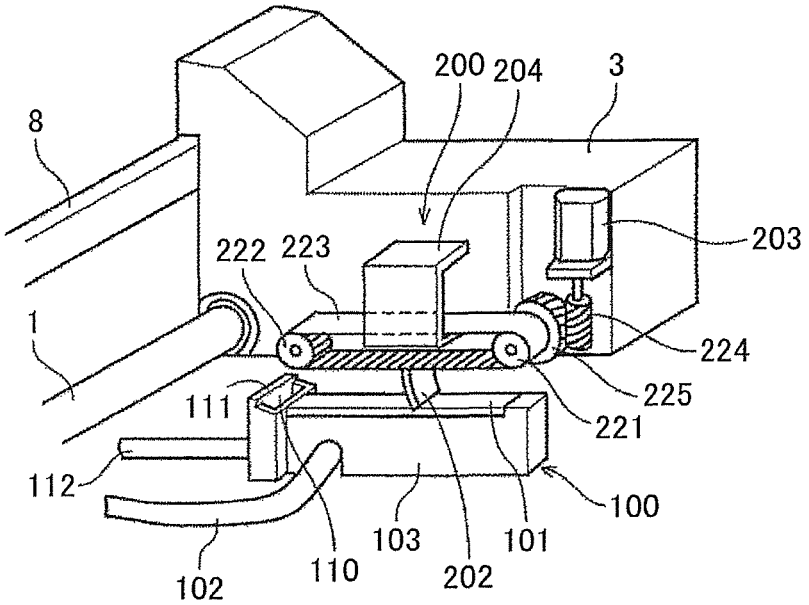
FIG. 5B is a perspective view of the liquid ejecting detector and the carriage.
Figure 6:
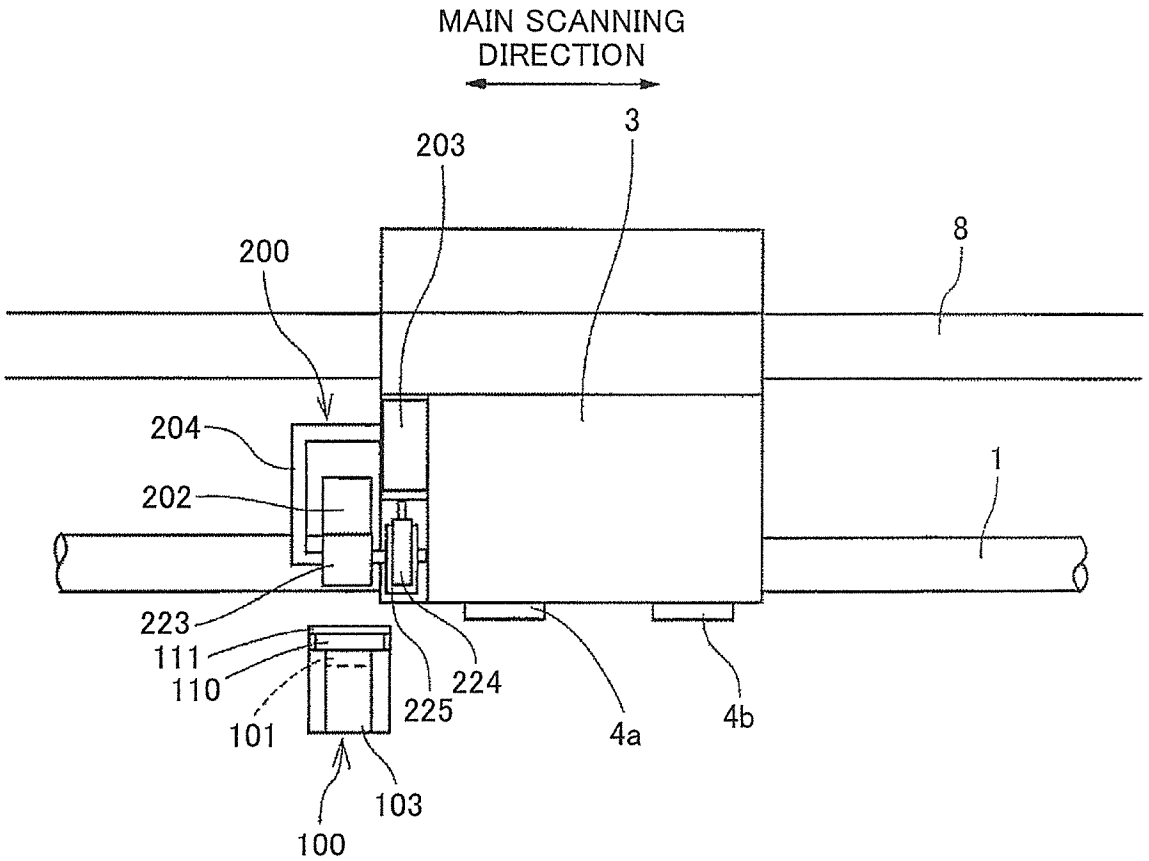
FIG. 6 is a front view of the liquid ejecting detector and the carriage.
Figure 7:
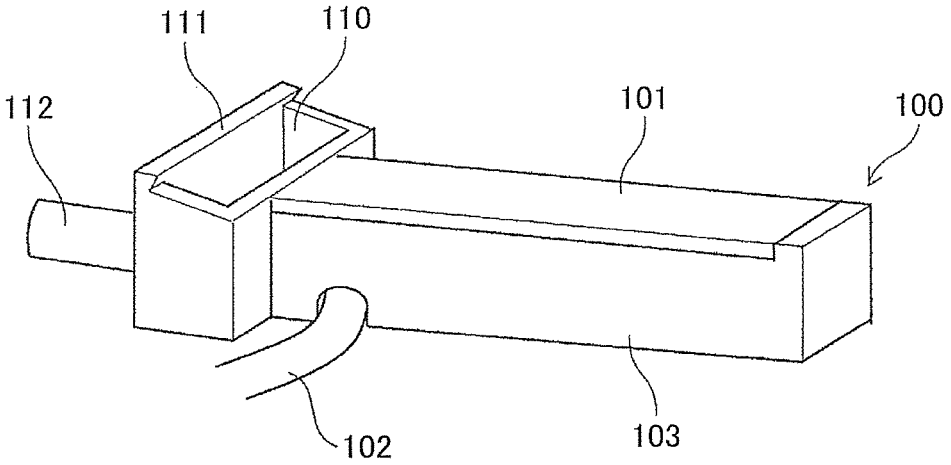
FIG. 7 is a perspective view of the liquid ejecting detector.
Figure 8:
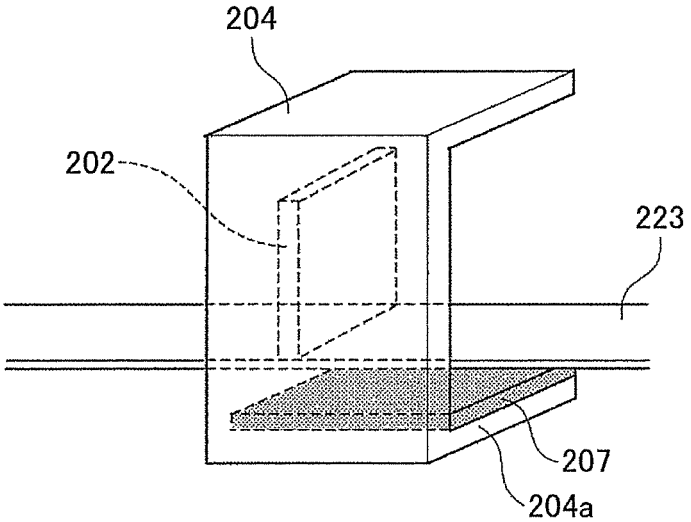
FIG. 8 is a perspective view of a wiper retraction cover.

Next, the liquid ejecting detector 100 is explained, referring to FIG. 4 through FIG. 8. FIG. 4 is a side view of the liquid ejecting detector 100 and the carriage 3. FIG. 5A is a perspective view of the liquid ejecting detector 100 and the carriage 3. FIG. 5B is a perspective view of the liquid ejecting detector 100 and the carriage 3 when the wiper 202 is wiping the liquid ejecting detector 100. FIG. 6 is a front view of the liquid ejecting detector 100 and the carriage 3. FIG. 7 is a perspective view of the liquid ejecting detector 100. FIG. 8 is a perspective view of a wiper retraction cover 204.

The liquid ejecting detector 100 has the electrode plate 101, which has a droplet landing surface, on the upper surface of a holder 103 where the electrode plate 101 can face the nozzle surface 41 of the recording head 4. The top surface (a facing surface) of the electrode plate 101 is the droplet landing surface.

The holder 103 is made of an insulating material, such as plastic.

The electrode plate 101 is a conductive metal and preferably made of a material resistant to rust and ink. For example, the electrode plate 101 material may be a stainless steel (SUS304), a copper alloy coated with nickel (Ni), or a copper alloy coated with palladium (Pd). The droplet landing surface of the electrode plate 101 is preferably water-repellent coated.

The electrode plate 101 is connected to the ejection detector 531 through an electrical connection using a lead 102. The ejection detector 531 is explained hereinafter.

As illustrated in FIG. 7, the holder 103 has an opening 110 at the terminative end of the wiping direction of the wiper 202. A part (a scraping part) of the rim of the opening 110 is a wiper cleaner 111 which serves as a cleaner to remove waste liquid (droplets adhered to the wiper 202) from the wiper 202.

The holder member 103 has a waste liquid tube 112 which is a passage from the bottom of the opening 110 to a waste liquid tank (not illustrated in the drawing). A suction pump (not illustrated in the drawing) is installed in the passage leading to the waste liquid tank, so that waste liquid accumulated in the bottom of the opening 110 is discharged to the waste liquid tank using the suction pump.

The carriage 3 has the cleaning unit 200 which serves as a cleaner, and the cleaning unit 200 includes the wiper 202 which wipes droplets off the top surface (the droplet landing surface) of the electrode plate 101 while moving in the aligning direction of the nozzles.

The wiper 202 is made of, for example, an ethylene propylene diene monomer rubber (EPDM). Water repellency of EPDM is not so high, so that the surface of the electrode plate 101 may have higher water repellency, compared to the wiper 202. When the surface of the electrode plate 101 has higher water repellency, compared to the wiper 202, ink is easily wiped off the electrode plate 101.

The wiper 202 is attached to a timing belt 223 which circulates around a driving pulley 221 and a driven pulley 222. A driving motor 203 attached to the carriage 3 drives the driving pulley 221 through the intermediaries of a worm gear 224 and a gear 225. In this way, the wiper 202 moves in the direction of an arrow in FIG. 4 along with the circulation of the timing belt 223.

The cleaning unit 200 has the wiper retraction cover 204 which covers the wiper 202 at a retracted position. When the wiper 202 is not in use, the wiper 202 is retracted inside the wiper retraction cover 204, in order to prevent a slight amount of waste liquid adhered to the wiper 202 from being scattered during operation of the carriage 3.

As illustrated in FIG. 8, the bottom surface of the wiper retraction cover 204 serves as a waste liquid receptacle 204*a* which receives waste liquid that drips from the wiper 202. On the waste liquid receptacle 204*a*, an absorber 207 is provided in order to absorb and retain waste liquid.

Returning to FIG. 4, the ejection detector 531 is explained.

As illustrated in FIG. 4, the ejection detector 531 has a high-voltage supply 701 which applies high voltage VE (e.g., 750 V) to the electrode plate 101. The main control unit 500A controls on/off state of the high-voltage supply 701.

Furthermore, the ejection detector 531 includes a band-pass filter (BPF) 702 which inputs a signal corresponding to an electronic change that occurs when a droplet lands onto the electrode plate 101, an amplifier (AMP) 703 which amplifies the signal, and an analog-digital convertor (ADC) 704 which converts the amplified signal from analog format to digital format. The conversion outcome of the ADC 704 is entered to the main control unit 500A.

The nozzle surface 41 of the recording head 4 is facing the electrode plate 101 when a detection of droplet ejection is performed. Then, high voltage VE is applied to the electrode plate 101, so that an electric potential difference is provided between the nozzle surface 41 and the electrode plate 101. Here, the electrode plate 101 is positively charged (positive voltage) and the nozzle surface 41 of the recording head 4 is negatively charged (negative voltage).

In this environment, the recording head 4 ejects one or more liquid droplets for detection from each nozzle in order.

Here, the droplet, which is ejected from one of the negatively charged nozzles of the recording head 4, is also negatively charged. When the negatively charged droplet lands onto the positively charged electrode plate 101, the high voltage VE applied to the electrode plate 101 slightly changes.

Then, the BPF 702 extracts the changed amount (alternating-current (AC) component). The extracted changed amount is amplified in the AMP 703 and converted in the ADC 704 from analog format to digital format. The changed amount converted in this way is entered to the main control unit 500A as a measurement result (detection result).

The main control unit 500A determines whether or not the measurement result (the changed amount) is greater than the predetermined threshold value. In a case that the measurement outcome is greater than the threshold value, the main control unit 500A determines that the droplet is ejected (ejected). On the other hand, in a case that the measurement result is not greater than the threshold value, the main control unit 500A determines that the droplet is not ejected (not ejected).

Additionally, ejected/not ejected determination of a nozzle takes 0.5 to 10 msec in the case that droplets are ejected to the electrode plate 101 from each nozzle in order. After all nozzles are determined to be either ejected or not ejected, the high voltage VE applied to the electrode plate 101 is turned off.

Figure 9A:
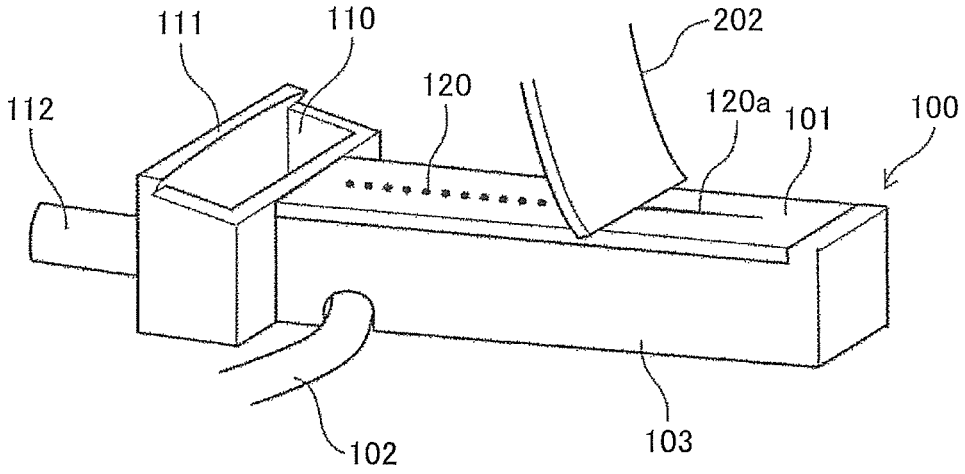
FIG. 9A is a drawing for an explanation of a wiping action of a wiper to wipe a top surface (a droplet landing surface) of an electrode plate.
Figure 9B:
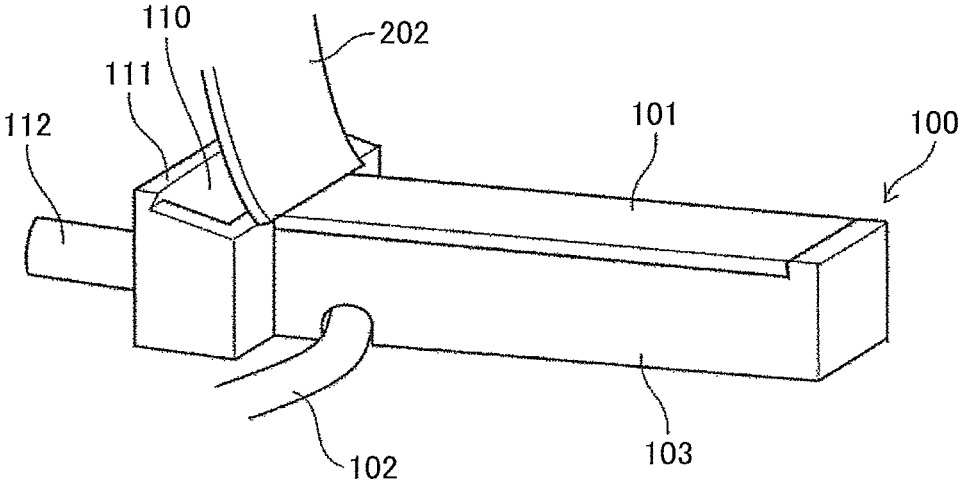
FIG. 9B is a drawing for an explanation of the wiping action of the wiper to wipe the top surface (the droplet landing surface) of the electrode plate.
Figure 9C:
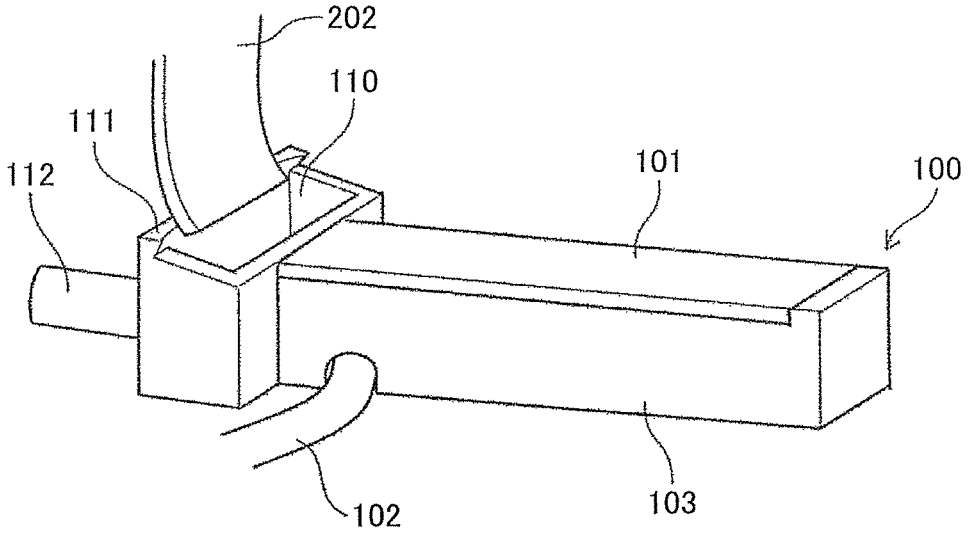
FIG. 9C is a drawing for an explanation of the wiping action of the wiper to wipe the top surface (the droplet landing surface) of the electrode plate.

Next, a wiping action performed by the wiper 202 of the cleaning unit 200 to wipe the top surface (the droplet landing surface) of the electrode plate 101 attached to the liquid ejecting detector 100 is explained, referring to FIGS. 9A through 9C. FIGS. 9A through 9C are perspective views of the liquid ejecting detector for explaining the wiping action.

First, the driving motor 203 of the cleaning unit 200 is driven to move the wiper 202. In this way, the wiper 202 wipes off ink 120 that is ejected onto the electrode plate 101 attached to the liquid ejecting detector 100, as illustrated in FIG. 9A.

Then, as illustrated in FIG. 9B, some of the ink 120 wiped with the wiper 202 is discharged into the opening 110.

Then, as illustrated in FIG. 9C, the wiper 202 is moved relative to the wiper cleaner 111, so that the wiper cleaner 111 scrapes off the ink adhered to the wiper 202 to clean the wiper 202.

Figure 10A:
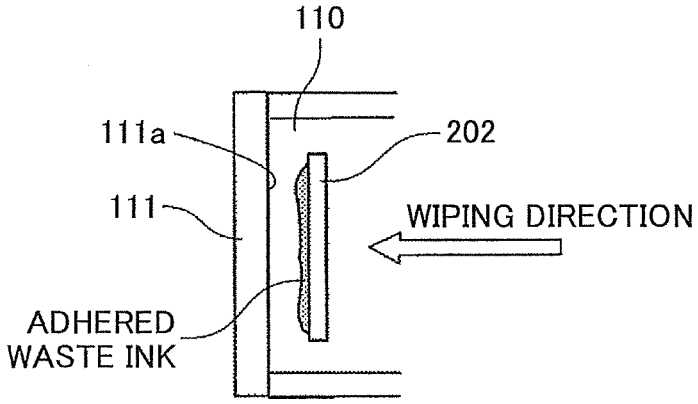
FIG. 10A is a drawing for an explanation of a condition of waste ink at the time of a wipe cleaning.
Figure 10B:
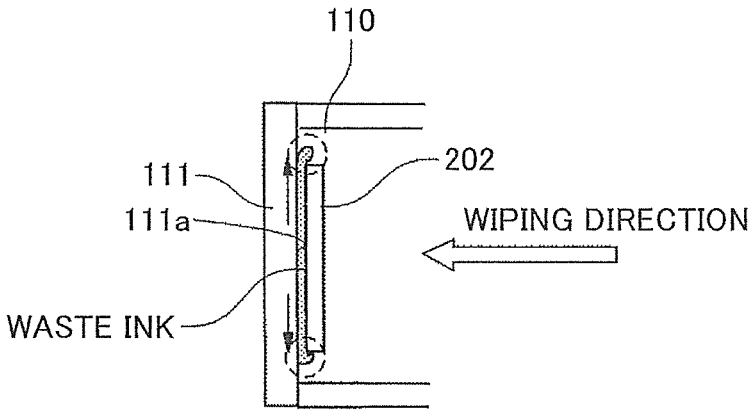
FIG. 10B is a drawing for an explanation of the condition of waste ink at the time of the wipe cleaning.
Figure 11A:
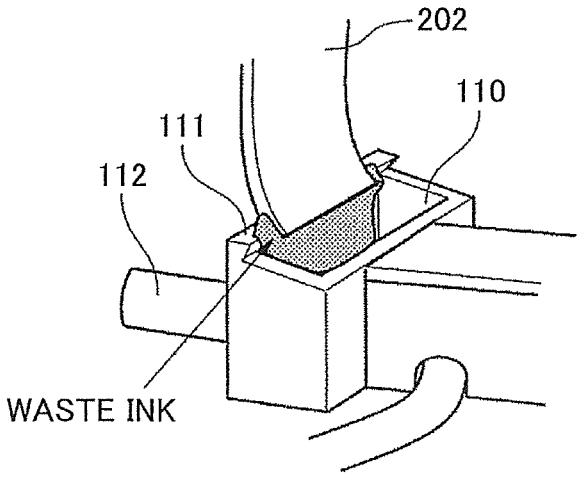
FIG. 11A is a drawing for an explanation of the condition of waste ink at the time of the wipe cleaning.
Figure 11B:
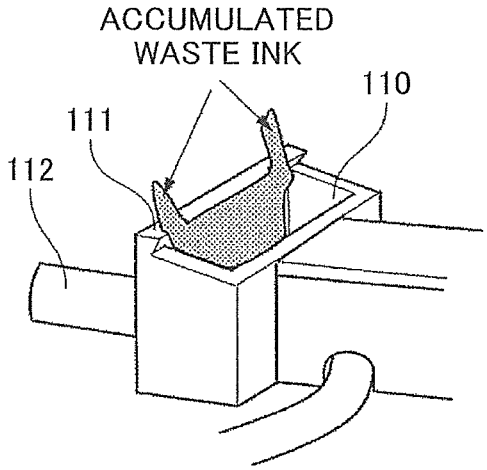
FIG. 11B is a drawing for an explanation of the condition of waste ink at the time of the wipe cleaning.

Next, a cleaning performance of the liquid ejecting detector 100 at the time of the above-described wipe cleaning is explained, referring to FIGS. 10A, 10B, 11A, and 11B. FIGS. 10A and 10B are drawings illustrating cleaning performances of the liquid ejecting detector 100. FIGS. 11A and 11B are drawings illustrating the conditions of the waste ink accumulation caused by the cleaning of the wiper 202.

As illustrated in FIG. 10A, waste ink is adhered to the surface (the wiping surface) of the wiper 202 after the wiper 202 wipes off the ink 120.

As illustrated in FIG. 10B, when the scraper 111*a* of the wiper cleaner 111, which is parallel to the wiper 202, makes contact with the wiping surface of the wiper 202 to scrape the wiping surface of the wiper 202, the waste ink is moved in the direction (the directions of arrows) perpendicular to the wiping direction (wiping direction). The waste ink moved as described above runs off the side ends of the wiper 202 (as described in FIG. 10B with the dashed-line circles).

Although in FIG. 10B the amount of adhered waste ink is exaggeratingly described and therefore the amount of the waste ink that runs off the side ends after one action looks to be quite a lot, the amount of ink that is ejected onto the electrode plate 101 during an ejection detecting action is actually very little. Hence, as the cleaning action with the wiper 202 is repeatedly performed, waste ink runs off the side ends of the wiper 202 as illustrated in FIG. 10B.

As a result, as illustrated in FIGS. 11A and 11B, waste ink is accumulated on the wiper cleaner 111 in the areas which correspond to the side ends of the wiper 202.

Here, in a case where the waste ink is accumulated heightwise, the accumulated waste ink may be attached to the nozzle surface 41 of the recording head 4 of the carriage 3, which goes back and forth above the accumulated waste ink. Furthermore, the accumulated waste ink may cause contamination of a conveyed sheet or the conveying pathway.

Moreover, even though the waste ink accumulating areas are not on the scanning direction of the carriage 3, the accumulated waste ink may be retransferred to the wiper 202. Retransferred accumulated waste ink may be attached to the electrode plate 101 at the time of the next cleaning action of the electrode plate 101. In this case, the accumulated waste ink may be rubbed by the recording head 4, which may cause an image defect.

The embodiments explained below are solutions to the problems caused by the accumulated waste ink as described above.

Figure 12:
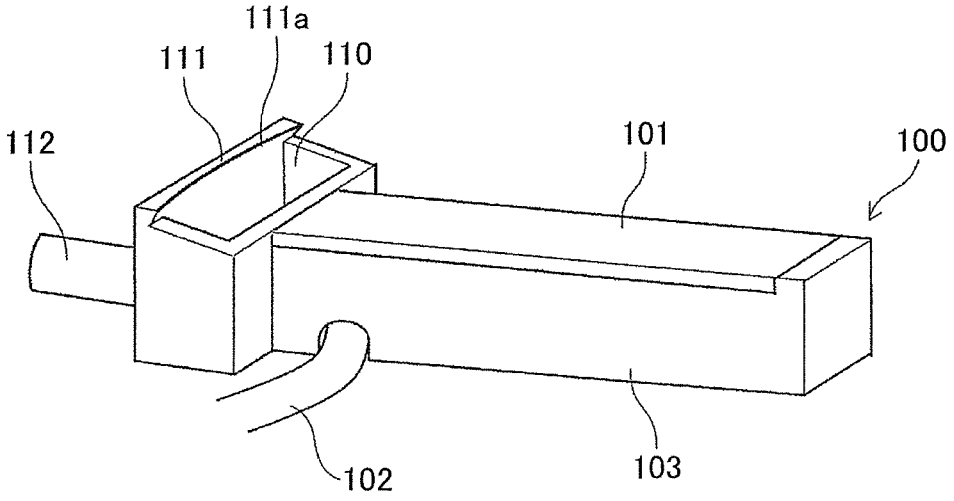
FIG. 12 is a perspective view of the liquid ejecting detector according to the first embodiment of the present invention.
Figure 13A:
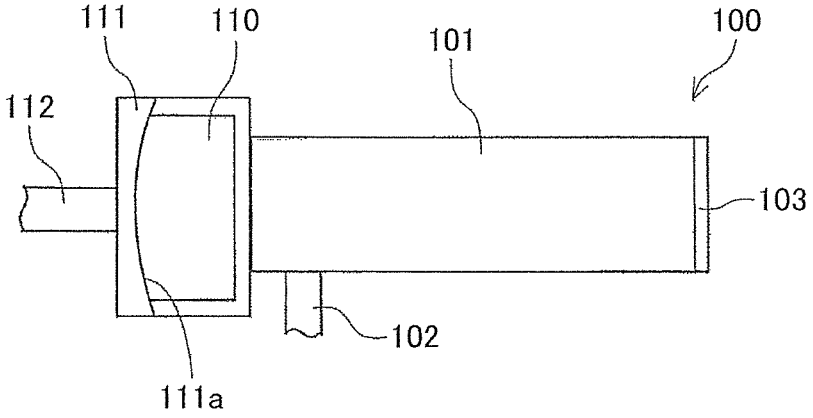
FIG. 13A is a plan view of the liquid ejecting detector according to the first embodiment of the present invention.
Figure 13B:
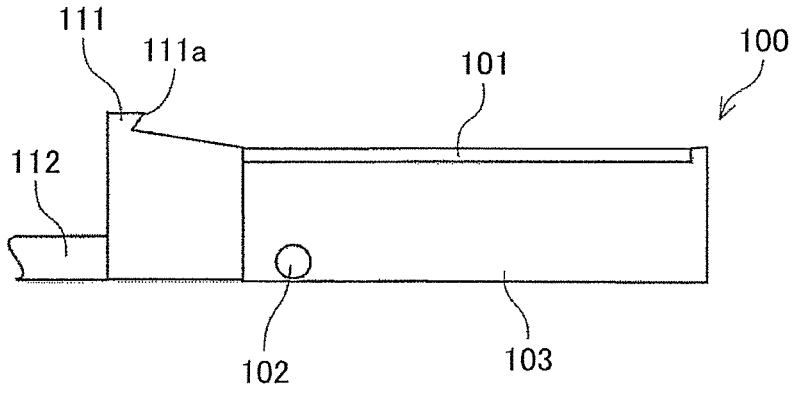
FIG. 13B is a side view of the liquid ejecting detector according to the first embodiment of the present invention.
Figure 13C:
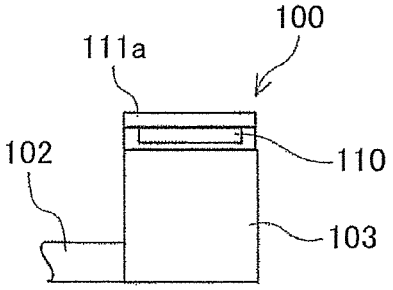
FIG. 13C is a front view of the liquid ejecting detector according to the first embodiment of the present invention.

First, a first embodiment is explained, referring to FIG. 12 and FIGS. 13A to 13C. FIG. 12 is a perspective view of the liquid ejecting detector 100 according to the first embodiment. FIG. 13A is a plan view of the liquid ejecting detector 100, FIG. 13B is a side view of the liquid ejecting detector 100, and FIG. 13C is a front view of the liquid ejecting detector 100.

In the present embodiment, the scraper 111*a*, which has a contact surface where the wiper 202 makes contact with the wiper cleaner 111, is in a curved shape so that the central part has a convex shape toward the wiping direction. In other words, the scraper 111*a* of the wiper cleaner 111 is in such a shape as the wiper 202 makes contact gradually from the side ends to the center in the direction perpendicular to the wiping direction of the wiper 202.

Next, the cleaning action of the wiper 202 according to the present embodiment is explained, referring to FIGS. 14A to 14D.

Figure 14A:
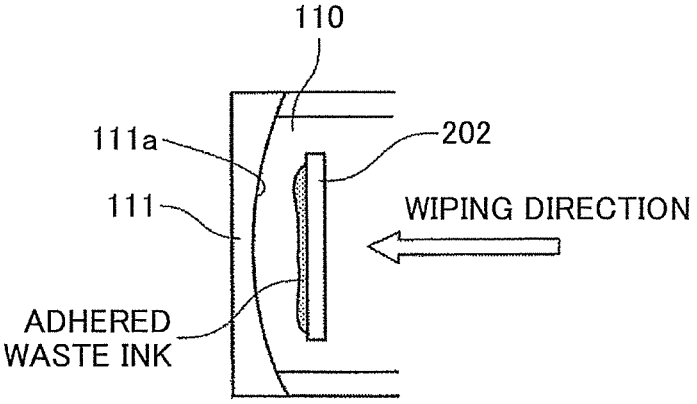
FIG. 14A is a drawing for an explanation of a cleaning action of the liquid ejecting detector according to the first embodiment of the present invention.
Figure 14B:
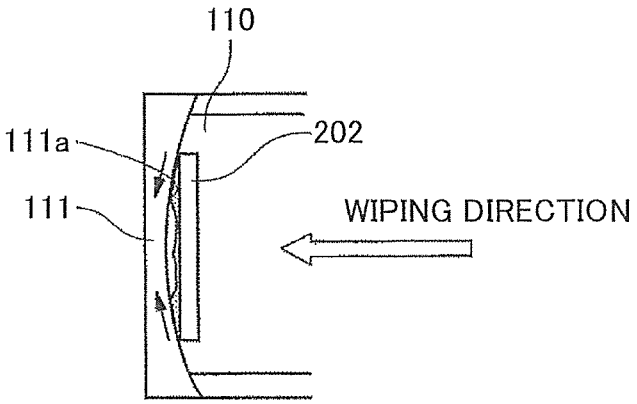
FIG. 14B is a drawing for an explanation of the cleaning action of the liquid ejecting detector according to the first embodiment of the present invention.

First, as illustrated in FIG. 14A, when a wiper cleaning is performed, the wiper 202 with waste ink moves in the wiping direction. Then, as illustrated in FIG. 14B, the side ends of the wiper 202 make contact with the scraper 111*a* (the contact surface) of the wiper cleaner 111.

Figure 14C:
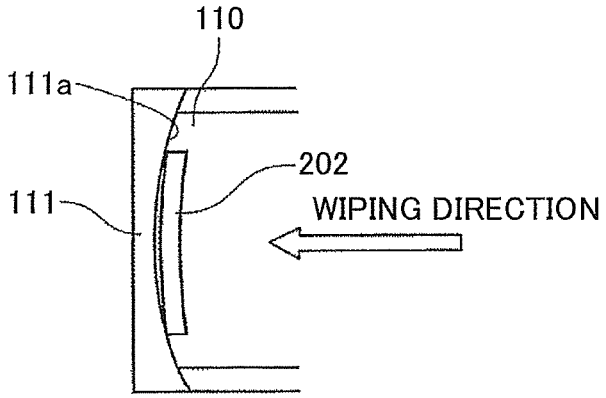
FIG. 14C is a drawing for an explanation of the cleaning action of the liquid ejecting detector according to the first embodiment of the present invention.
Figure 14D:
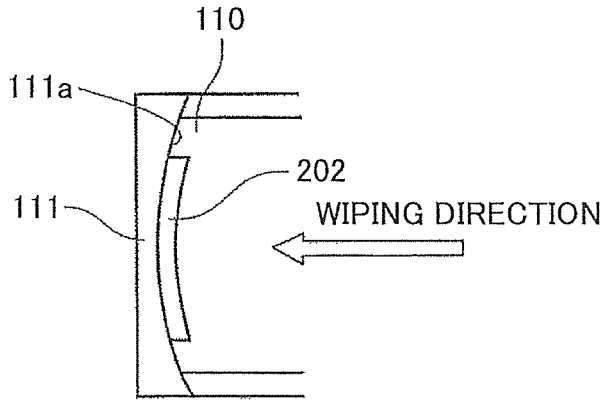
FIG. 14D is a drawing for an explanation of the cleaning action of the liquid ejecting detector according to the first embodiment of the present invention.

Then, as illustrated in FIGS. 14C and 14D, the surface of the wiper 202 gradually makes contact with the scraper 111*a* (the contact surface) of the wiper cleaner 111 as the wiper 202 shape changes by elastic deformation.

Therefore, the waste ink adhered to the wiper 202 is collected from the side ends to the inside (the center). In this way, the waste ink does not run off the side ends of the wiper 202.

Hence, the waste ink does not accumulate in the areas of the wiper cleaner 111 that correspond to the side ends of the wiper 202. Therefore, contamination of a sheet and the conveying pathway with accumulated waste ink is prevented and good cleaning quality of the wiper 202 is sustained for a long period of time.

Figure 15:
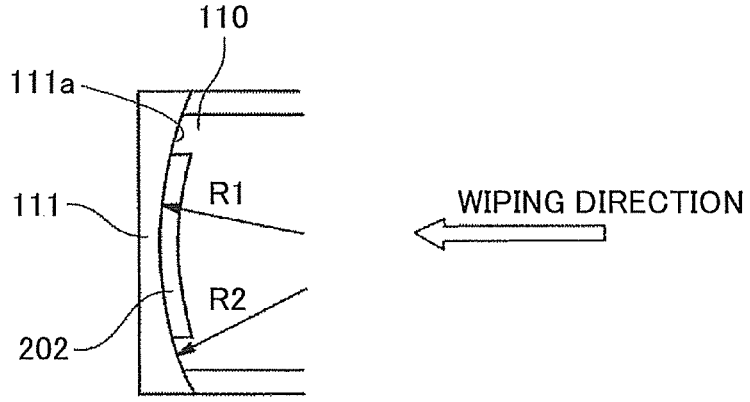
FIG. 15 is a plan view of a wiper and a cleaner according to a second embodiment of the present invention.

Next, a second embodiment is explained, referring to FIG. 15. FIG. 15 is a plan view of the wiper 202 and the cleaner according to the second embodiment. In the present embodiment, the relationship is defined between the curve of the wiper 202 while changing shape by elastic deformation and the curve of the scraper 111*a* of the wiper cleaner 111.

As illustrated in FIG. 15, the radius of an arc formed by the contact surface of the wiper 202, when the wiper 202 makes contact with the wiper cleaner 111 (the cleaner) and receives pressure, is indicated as R1. The pressure from the wiper cleaner 111 causes gradual elastic deformation of the wiper 202. In other words, when the wiper 202 makes contact with the wiper cleaner 111, the side ends of the wiper 202 touch the wiper cleaner 111 first, and then the central part is curved toward the wiping direction.

Meanwhile, the degree of curve that the wiper 202 can make is dependent on a material and a figure, such as a thickness and a length, of the wiper 202. Here, the radius R1 of the arc formed by the contact surface of the wiper 202 when the wiper 202 is curved to the fullest extent is indicated as R1max.

In addition, the radius of the arc of the scraper 111*a* (the contact surface) of the wiper cleaner 111 is indicated as R2.

Here, in the present embodiment, the material and the figure such as the thickness and the length of the wiper 202 is predetermined so as to maintain an R2>R1max relationship. That is to say, the part (the scraper 111*a*) of the cleaner that makes contact with the wiper 202 is in a shape of an ark having a bigger curvature radius than the curvature radius of the arc formed by the wiper 202 curved to the fullest extent.

In this way, the entire area of the contact surface of the wiper 202 surely makes contact with the scraper 111*a* of the wiper cleaner 111, which enables the entire area of the contact surface of the wiper 202 to be surely cleaned.

Figure 16:
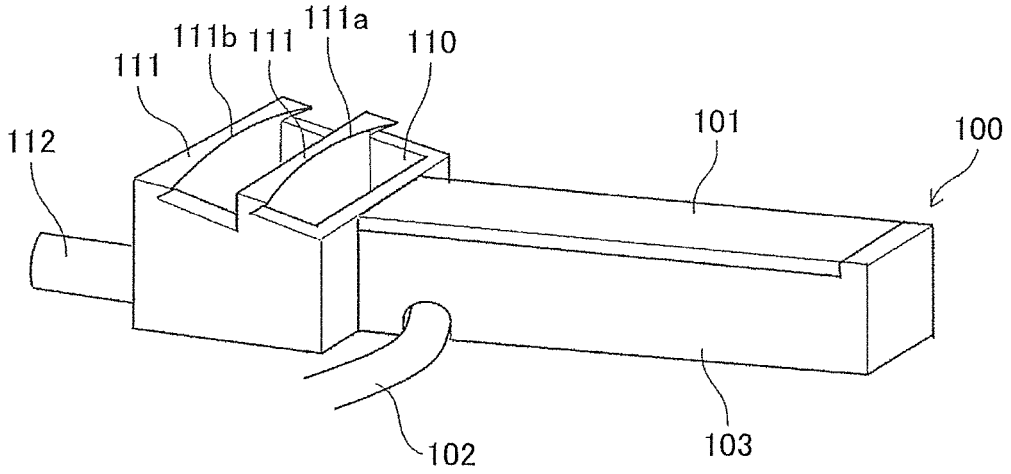
FIG. 16 is a perspective view of a liquid ejecting detector according to a third embodiment of the present invention.

Next, a third embodiment is explained, referring to FIG. 16. FIG. 16 is a perspective view of the liquid ejecting detector 100 according to the third embodiment.

In the present embodiment, multiple wiper cleaners 111 and 111 are arranged in the moving direction (the wiping direction) of the wiper 202. Therefore, after waste ink adhered to the wiper 202 is scraped off with the scraper 111*a* of the wiper cleaner 111 in the upstream of the moving direction, the waste ink is scraped off with the scraper 111*b* of the wiper cleaner 111 in the downstream of the moving direction. In this way, the cleaning quality of one cleaning action is enhanced.

Figure 17:
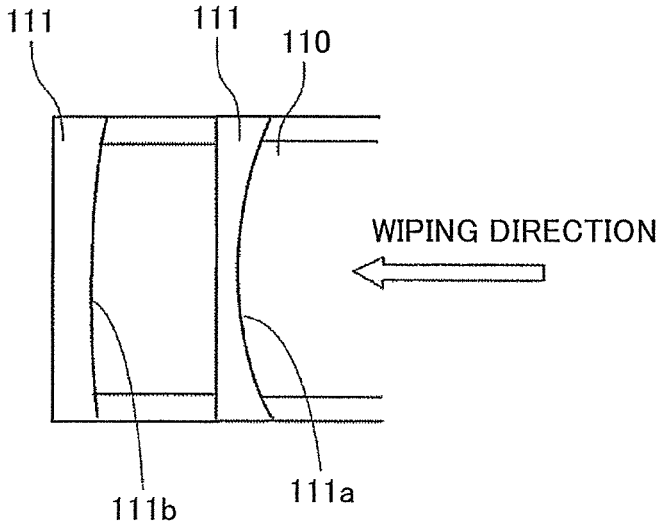
FIG. 17 is a plan view of a wiper cleaner of a liquid ejecting detector according to a fourth embodiment of the present invention.

Next, a fourth embodiment of the present invention is explained, referring to FIG. 17. FIG. 17 is a plan view of the wiper cleaner 111 according to the fourth embodiment.

In the present embodiment, regarding the configuration according to the third embodiment, the curve of the scraper 111*b* in the downstream of the moving direction (the wiping direction) of the wiper 202 is milder than the curve of the scraper 111*a* in the upstream (the curvature is smaller). In other words, the curvature radius of the contact surface of the scraper 111*b* in the downstream is bigger than the curvature radius of the contact surface of the scraper 111*a* in the upstream.

Being configured in such a way as described above, after waste ink adhered to the wiper 202 is scraped off with the scraper 111*a* of the wiper cleaner 111 in the upstream of the moving direction first, the waste ink is scraped off with the scraper 111*a* of the wiper cleaner 111 in the downstream of the moving direction.

Here, the curve of the scraper 111*b* of the wiper cleaner 111 in the downstream of the moving direction of the wiper 202 is milder than the curve of the scraper 111*a* of the wiper cleaner 111 in the upstream.

This makes a difference in the areas that receive higher contact pressure at the time that the wiper 202 makes contact with the wiper cleaners 111. In the area with higher contact pressure, stronger force is provided for scraping off waste ink. In other words, waste ink is surely scraped off in broader area, which ensures that the entire area of the wiper 202 gets cleaned.

For example, when waste ink adhered to the wiper 202 is first scraped off with the wiper cleaner 111 in the upstream, the side ends of the wiper 202 make contact first with the wiper cleaner 111. Then even when the wiper 202 is curved so that the entire area of the wiper 202 makes contact with the scraper 111*a* of the wiper cleaner 111, the contact pressure between the scraper 111*a* and the wiper 202 is higher in the areas close to the side ends of the wiper 202. Therefore, waste ink in the area close to the side ends of the wiper 202 is easily scraped off, compared to the area close to the center of the wiper 202, which means, relatively speaking, that waste ink is more likely to remain in the area close to the center of the wiper 202.

Here, the curve of the scraper 111*b* of the wiper cleaner 111 in the downstream is milder, or almost straight, so that higher contact pressure is applied in the area close to the center of the wiper 202. In this way, waste ink in the area close to the center of the wiper 202 is surely scraped off as well, which ensures that the entire area of the wiper 202 gets cleaned.

Figure 18:
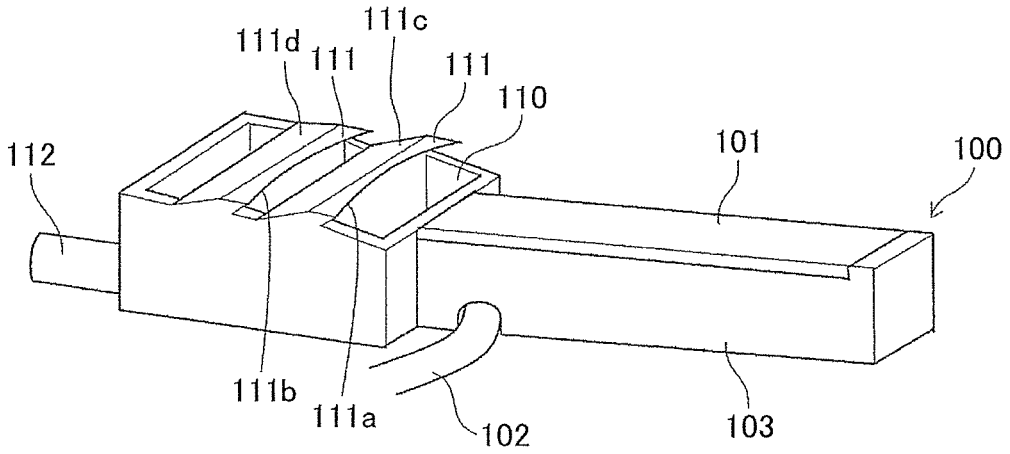
FIG. 18 is a perspective view of a liquid ejecting detector according to a fifth embodiment of the present invention.
Figure 19:
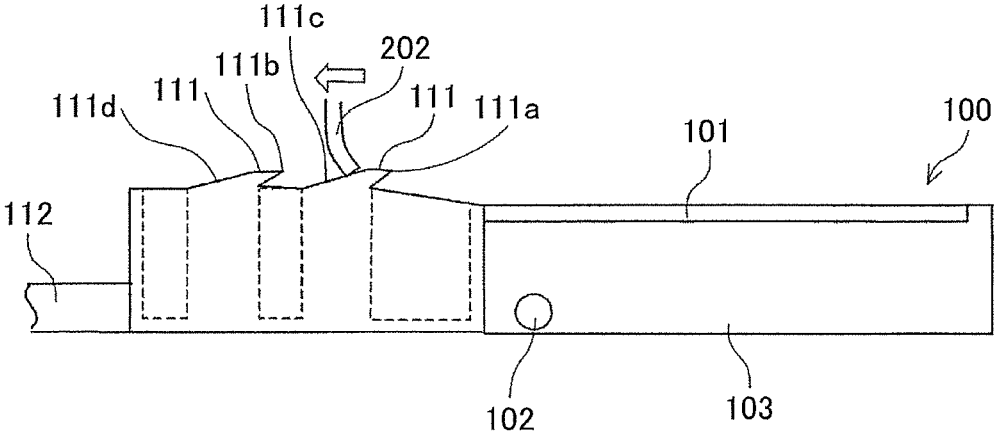
FIG. 19 is a front view of the liquid ejecting detector according to the fifth embodiment of the present invention.

Next, a fifth embodiment is explained, referring to FIG. 18 and FIG. 19. FIG. 18 is a perspective view of the liquid ejecting detector 100 according to the fifth embodiment. FIG. 19 is a front view of the liquid ejecting detector 100 according to the fifth embodiment.

In the present embodiment, regarding the configuration according to the fourth embodiment, the wiper cleaner 111 has a sloping surface 111*c* and a sloping surface 111*d* respectively on the other side of the scraper 111*a* and the scraper 111*b* (in the downstream of the moving direction of the wipers), which incline in such an angle as the contact pressure of the wiper 202 gradually decreases.

This prevents the wiper 202 from immediately getting away from the wiper cleaner 111 after waste ink adhered to the wiper 202 is scraped off by the scraper 111*a* and the scraper 111*b* of the wiper cleaner 111.

That is to say, waste ink may remain on the wiper 202 even after the wiper cleaner 111 cleans the wiper 202. In this case, if the wiper 202 immediately recovers from the curved state to the original state, the remaining waste ink may be scattered.

Here, the sloping surface 111*c* and the sloping surface 111*d* are provided respectively in the downstream of the scraper 111*a* and the scraper 111*b*, so that the curving degree of the wiper 202 is reduced by the time that the wiper 202 gets away from the wiper cleaner 111, compared to the time that the wiper 202 is on the top surface of the wiper cleaner 111.

In this way, elastic energy of the wiper 202 is decreased by the time that the wiper 202 gets away from the sloping surface 111*c* and the sloping surface 111*d*, which prevents waste ink from being scattered.

Although in the embodiments described above the droplet landing surface is provided on an electrode plate, a resistor (a resistor member) may be provided with a droplet landing surface, so that the ejection detection is performed based on a change of resistance value between terminals caused by landing of a droplet.

Furthermore, in the present disclosure, the term "sheet" is not limited to a sheet of paper but includes a sheet of overhead projector (OHP), cloth, glass, circuit board, etc. In other words, the term "sheet" may be used for anything that liquid such as ink droplet, etc., can be attached onto, including what is called recording-object medium, recording medium, recording paper, and recording sheet, etc. Moreover, the terms "image forming", "recording", "letter printing", "image printing", and "printing", are all considered to be equivalent.

Furthermore, in the present disclosure, the term "liquid ejector" refers to an apparatus which ejects liquid in order to form an image on a medium including paper, string, fiber, silk, leather, metal, plastic, glass, wood, ceramic, etc. Moreover, the term "image forming" not only means to provide on a medium an image with meanings such as a character and a figure, but also means to provide on a medium an image without meanings such as a pattern (or simply causing a droplet to land on a medium).

Furthermore, the term "ink" is not limited to what is caked ink unless otherwise specified, and is used as a collective term referring to any types of liquid that can be used for an image forming, such as what is called recording liquid, fixing liquid, liquid, etc. Therefore, the term "ink" includes a DNA sample, resist, pattern material, resin, etc.

Furthermore, the term "image" is not limited to a two-dimensional image but includes an image applied to a three-dimensional object and a three dimensional object itself formed as a three-dimensional figure.

The present invention is not limited to the disclosed embodiments and various variations and modifications may be made without departing from the scope of the present invention.

What is claimed is:

1. A liquid ejector comprising:

a head having a plurality of nozzles arranged along a first direction of a nozzle surface of the head to eject a droplet from the nozzles; and an ejection detector to detect whether or not a droplet is ejected from the plurality of nozzles of the head by detecting an electrical change generated when the droplet lands onto the ejection detector, the ejection detector comprising:

a droplet landing surface arranged opposed to the nozzle surface, on which the droplet ejected from the plurality of nozzles of the head lands;

a wiper to wipe the droplet off the droplet landing surface along the first direction; and a cleaner having a contact surface to remove the droplet adhered to the wiper by relatively moving the wiper and the contact surface in the first direction while the wiper deforms elastically by contact and pressed against the contact surface of the cleaner after the wiper wipes the droplet landing surface, wherein:

the contact surface having a curvature such that side ends of the wiper, arranged in a second direction perpendicular to the first direction, contacts with the contact surface at first, and then a center part of the wiper contacts the contact surface.

2. The liquid ejector according to claim 1, wherein the contact surface has an arc shape which is convex toward the first direction.

3. The liquid ejector according to claim 2, wherein the contact surface of the cleaner has an arc shape having a curvature radius greater than a curvature radius of an arc formed by the wiper deforming elastically to a fullest extent.

4. The liquid ejector according to claim 1, wherein a plurality of the cleaners are arranged in the first direction of the wiper.

5. The liquid ejector according to claim 4, wherein a curvature radius of an arc formed by a contact surface of each of the plurality of the cleaners increases toward downstream of the first direction of the wiper.

6. The liquid ejector according to claim 1, wherein the cleaner includes a sloping surface which inclines at such an angle that a contact pressure with the wiper gradually decreases as the wiper moves toward downstream of the sloping surface in the first direction of the wiper.

7. The liquid ejector according to claim 1, wherein the ejection detector detects whether or not the droplet is ejected from one of the plurality of the nozzles of the head by detecting an electrical change generated when the droplet lands onto the droplet landing surface.

8. A liquid ejecting detector to detect whether or not a droplet is ejected from a head having a plurality of nozzles comprising:

a droplet landing surface on which the droplet lands;

a wiper to wipe the droplet off the droplet landing surface; and a cleaner having a contact surface to remove the droplet adhered to the wiper, the wiper deformed elastically when being contact and pressed against the contact surface of the cleaner after the wiper wipes the droplet landing surface, wherein:

the contact surface having a curvature such that side ends of the wiper, arranged in a second direction perpendicular to the first direction, contacts with the contact surface at first, and then a center part of the wiper contacts the contact surface.

* * * * *